US008491409B2

(12) United States Patent
Turnpaugh et al.

(10) Patent No.: US 8,491,409 B2
(45) **Date of Patent: *Jul. 23, 2013**

(54) SILICONE GRIPS FOR GOLF CLUBS

(75) Inventors: Dennis Turnpaugh, Laurinburg, NC (US); Bruce Norton, Laurinburg, NC (US); Scott Guarino, Williamsburg, VA (US); Leroy Nopper, Williamsburg, VA (US)

(73) Assignee: Eaton Corporation, Cleveland, OH (US)

( * ) Notice: Subject to any disclaimer, the term of this patent is extended or adjusted under 35 U.S.C. 154(b) by 1044 days.

This patent is subject to a terminal disclaimer.

(21) Appl. No.: 11/619,739

(22) Filed: Jan. 4, 2007

(65) Prior Publication Data

US 2007/0173342 A1 Jul. 26, 2007

Related U.S. Application Data

(60) Provisional application No. 60/761,541, filed on Jan. 24, 2006.

(51) Int. Cl.
*A63B 53/14* (2006.01)

(52) U.S. Cl.
USPC ..... 473/300

(58) Field of Classification Search
USPC ..... 473/300–303
See application file for complete search history.

(56) References Cited

U.S. PATENT DOCUMENTS 4,452,456 A * 6/1984 Kochevar ..... 473/409
4,577,425 A 3/1986 Foster et al.
5,261,665 A * 11/1993 Downey ..... 473/303
5,316,531 A * 5/1994 Spence ..... 482/93
5,322,290 A * 6/1994 Minami ..... 473/201
5,709,005 A 1/1998 Brach, Jr. et al.
5,716,289 A * 2/1998 Okoneski ..... 473/297
5,890,308 A 4/1999 Harrington
6,718,675 B1 * 4/2004 Lu ..... 40/661.12
6,843,732 B1 * 1/2005 Huang ..... 473/300
7,160,202 B2 1/2007 Chen (Continued)

FOREIGN PATENT DOCUMENTS

CN 1636611 7/2005
JP 57-116259 U 7/1982

(Continued)

OTHER PUBLICATIONS

Notification of Transmittal of the International Search Report and the Written Opinion of the International Searching Authority, or the Declaration corresponding to International Application No. PCT/US2007/001450 mailed May 29, 2007.
Chinese Application No. 200710086044.0; filed Jan. 23, 2007; office action mailed Sep. 25, 2009.
Chinese Application No. 200710086044.0; filed Jan. 23, 2007; office action mailed Dec. 8, 2011.

(Continued)

*Primary Examiner* — Stephen L. Blau
(74) *Attorney, Agent, or Firm* — Myers Bigel Sibley & Sajovec, P.A.

(57) ABSTRACT

A grip for a golf club is provided. The grip comprises an elongated flexible sleeve that slips onto the shaft of a golf club and an elongated flexible panel of silicone material wrapped around and integrally bonded to the sleeve. The flexible panel comprises opposite first and second surfaces, opposite first and second edge portions joined together to define a longitudinal seam, and printed indicia on the panel first surface, wherein the printed indicia comprises silicone ink.

9 Claims, 7 Drawing Sheets

U.S. PATENT DOCUMENTS

| | | | | |
|---|---|---|---|---|
| 7,264,759 | B2 | 9/2007 | Lamkin | |
| 2002/0173371 | A1* | 11/2002 | Lamkin et al. | 473/300 |
| 2003/0062654 | A1 | 4/2003 | Lamkin | |
| 2004/0109980 | A1* | 6/2004 | Chen et al. | 428/131 |
| 2004/0128798 | A1* | 7/2004 | Cacicedo | 16/436 |
| 2004/0224786 | A1* | 11/2004 | Reardon | 473/300 |
| 2005/0159237 | A1 | 7/2005 | Lu | |
| 2005/0221909 | A1* | 10/2005 | Nam | 473/300 |
| 2007/0275789 | A1* | 11/2007 | Chen | 473/300 |

FOREIGN PATENT DOCUMENTS

| | | | | |
|---|---|---|---|---|
| JP | 9-135922 | | * | 5/1997 |
| JP | 09135922 | A | * | 5/1997 |
| JP | 2004-175814 | | | 6/2004 |
| JP | 3105424 | U | | 9/2004 |
| JP | 2005-010187 | | | 4/2005 |
| JP | 2005-218567 | | | 8/2005 |
| JP | 2012-82401 | | | 4/2012 |
| TW | 517677 | U | | 1/2003 |
| TW | 559099 | U | | 10/2003 |
| TW | 577340 | U | | 1/2006 |
| TW | M285373 | U | | 1/2006 |
| WO | WO 2007/016617 | A2 | | 2/2007 |

OTHER PUBLICATIONS

Chinese Application No. 200710086044.0; filed Jan. 23, 2007; office action mailed Aug. 3, 2012.

Chinese Application No. 200710086045.5; filed Jan. 23, 2007; office action mailed Nov. 6, 2009.

Chinese Application No. 200710086045.5; filed Jan. 23, 2007; office action mailed Jul. 21, 2011.

Japanese Application No. 2008-552334; filed Jan. 18, 2007; office action mailed Nov. 11, 2011.

Japanese Application No. 2008-552334; filed Jan. 18, 2007; office action mailed Oct. 18, 2012.

Japanese Application No. 2008-552325; filed Jan. 18, 2007; office action mailed Nov. 8, 2011.

Japanese Application No. 2008-552325; filed Jan. 18, 2007; office action mailed Oct. 18, 2012.

Taiwanese Application No. 096102502; filed Jan. 23, 2007; office action mailed Oct. 16, 2012.

Taiwanese Application No. 096102512; filed Jan. 23, 2007; office action mailed Oct. 16, 2012.

* cited by examiner

SILICONE GRIPS FOR GOLF CLUBS

CROSS-REFERENCE TO RELATED APPLICATION

This application claims priority to U.S. Provisional Application Ser. No. 60/761,541, filed Jan. 24, 2006, the disclosure of which is incorporated by reference in its entirety.

FIELD OF THE INVENTION

The present invention relates generally to grips and, more particularly, to grips for golf clubs.

BACKGROUND OF THE INVENTION

There are many different types of grips used today for a wide variety of items, including without limitation, golf clubs, tools (hammer handles, etc.), racquets (hand ball, badminton, or tennis racquets), bats (baseball or softball), pool cues, umbrellas, fishing rods, etc. Slip-on golf club grips made of a molded rubber material or synthetic plastic are well known in the golf industry. The term "slip-on" as employed herein refers to a grip that slides on to a shaft or handle and is secured by way of an adhesive or the like. Slip-on grips are available in many shapes and forms.

Golf club grips conventionally are printed with some amount of text, patterns and/or graphics. For example, many golf club grips include the name of the golf club manufacturer, and/or include a logo or symbol, and/or include one or more patterns/colors. Because of their shape, slip-on type golf club grips can be somewhat difficult to print using conventional methods. Moreover, slip-on golf club grips for putters can have substantially irregular shapes and configurations that can make printing difficult. Also, the printing on conventional golf club grips can be damaged by wear and the effects of weather.

Silicone rubber is used commercially as a substitute for natural rubber products. Silicone rubber has advantageous properties over natural rubber with respect to durability, flexibility over a wide temperature range and resistance to ozone and ultraviolet attack. Because of these superior properties, some golf club manufacturers are manufacturing golf clubs with grips formed from silicone. Unfortunately, silicone can be a somewhat difficult material upon which to print using conventional methods.

Thus, a need has arisen for improved printing methods for slip-on type golf club grips, particularly silicone grips.

SUMMARY OF THE INVENTION

A grip for a golf club is provided. The grip comprises an elongated flexible sleeve that slips onto the shaft of a golf club and an elongated flexible panel of silicone material wrapped around and integrally bonded to the sleeve. The flexible panel comprises opposite first and second surfaces, opposite first and second edge portions joined together to define a longitudinal seam, and printed indicia on the panel first surface, wherein the printed indicia comprises silicone ink.

DETAILED DESCRIPTION OF THE INVENTION

Figure 1:
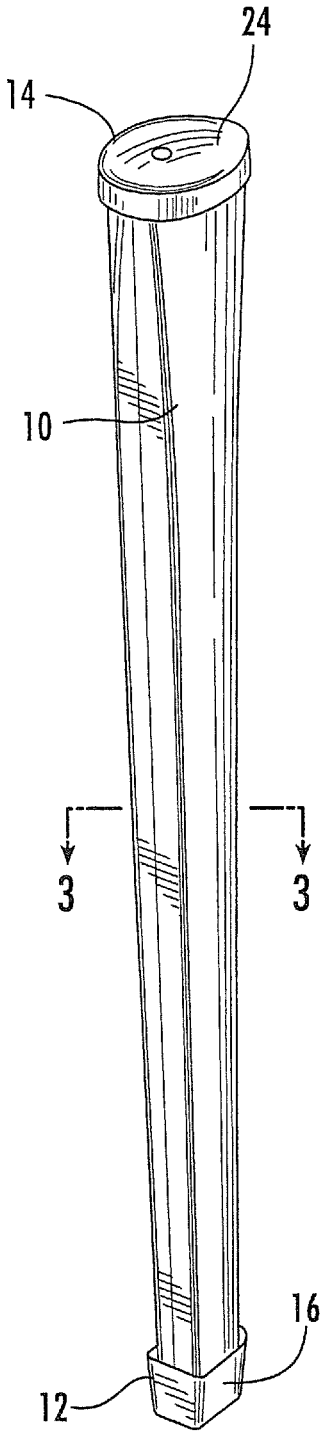
FIG. 1 is a perspective view of a flexible sleeve for a golf club grip, according to some embodiments of the present invention.
Figure 2:
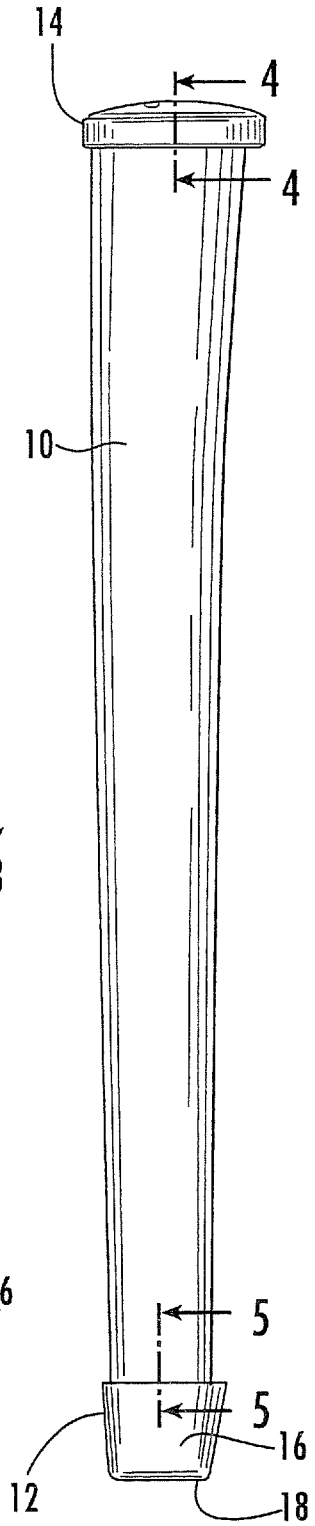
FIG. 2 is a side elevational view of the flexible sleeve of FIG. 1.
Figure 3:
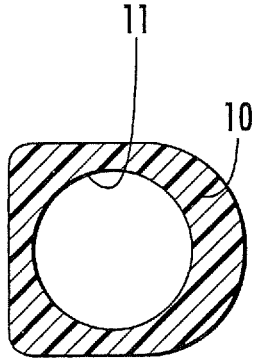
FIG. 3 is a cross-sectional view of the sleeve of FIG. 1 taken along Lines 3-3.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise. All publications, patent applications, patents, and other references mentioned herein are incorporated herein by reference in their entireties.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

Even though embodiments of the present invention are particularly suited for use as golf club grips and reference is made specifically thereto, it should be immediately apparent that embodiments of the present invention are applicable to any device/article requiring the use of a hand grip, for example, tools, ski poles, racquets, and the like.

Referring initially to FIGS. 1-5, an elongated flexible sleeve 10 or underlist for a grip that is configured to slip onto and be secured to a golf club shaft, according to embodiments of the present invention, is illustrated. The sleeve/underlist 10 has an internal passageway 11 configured to receive a golf club shaft. The illustrated sleeve 10 is for a putter and has a generally flat, elongated front wall portion 13 and a tapered configuration wherein a lower end (proximal end) has a circumference that is smaller than a circumference of the upper (distal) end. However, golf club grips according to some embodiments of the present invention may be designed for virtually any type of golf club, namely both putters and so-called "swing grips" for irons and woods. As such, sleeves according to embodiments of the present invention may have various shapes and configurations depending on the type of golf club on which the sleeve is to be attached.

The illustrated sleeve 10 is formed from a resilient polymeric material such as, for example, silicone, natural rubber, synthetic rubber, polyurethane, etc. In one embodiment, the sleeve is a silicone rubber available from Dow, GE Silicone or Wacker, for example. Moreover, the sleeve 10 may comprise a "dual-durometer" material wherein hardness of the sleeve material is different at different portions of the sleeve. As is known to those skilled in the art, a durometer is an international standard for the hardness measurement of rubber, plastic and other non-metallic materials. Durometers are described in the American Society for Testing and Material specification ASTM D2240. In one embodiment, the sleeve may have a hardness range of about 50 to 70 Durometer Shore A.

The illustrated sleeve 10 includes a proximal end 12 and an opposite distal end 14. A nipple 16 is located at the proximal end 12. The nipple 16 includes an aperture 18 in communication with passageway 11 and through which a golf club shaft is inserted. The illustrated nipple 16 has a tapered outer peripheral wall portion 20 that is spaced apart from the body of the nipple 16 and that defines an upwardly facing circumferential slot 22. A cap 24 is located at the distal end 14 and has an outer peripheral wall portion 26 that is spaced apart from the body of the cap 24. The outer peripheral wall portion 26 defines a downwardly facing circumferential slot 28, as illustrated. Embodiments of the present invention, however, are not limited to the illustrated sleeve 10.

Figure 6:
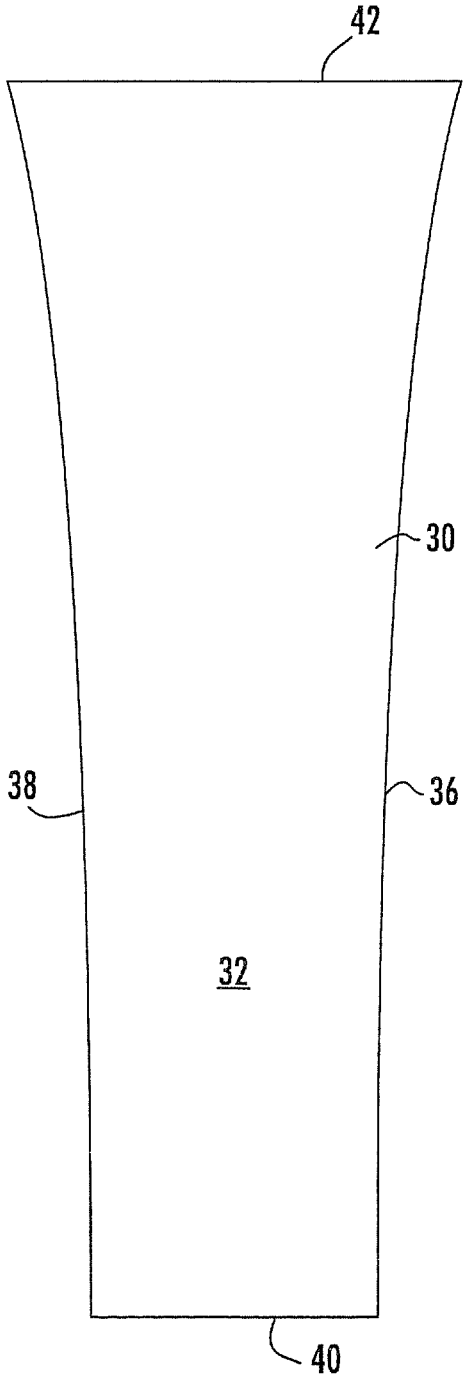
FIG. 6 is a plan view of a flexible silicone panel that is configured to be wrapped around and bonded to the flexible sleeve of FIG. 1, according to some embodiments of the present invention.

Referring to FIG. 6, an elongated flexible panel 30 of silicone that is configured to be wrapped around and integrally bonded to sleeve 10, is illustrated. The illustrated panel 30 includes opposite first and second surfaces 32,34, opposite first and second edge portions 36,38, and opposite proximal and distal end portions 40,42. The distal end 42 has a width greater than that of the proximal end 40 and the first and second edge portions 36,38 taper outwardly toward the distal end 42, as illustrated, in order to conform with the shape of the sleeve 10. The illustrated panel 30 has a configuration such that, when wrapped around sleeve 10, the opposite first and second edge portions 36,38 will join together to define a longitudinal seam. The panel may have a thickness of 0.002 to 0.006 inches.

Flexible panels according to embodiments of the present invention can have any shape and configuration necessary depending upon the shape and configuration of a sleeve around which they are to be wrapped and bonded. Embodiments of the present invention, however, are not limited to the illustrated shape and configuration of panel 30. Additionally, the panel 30 has been described as wrapped around the sleeve 10; alternatively a panel may be overmolded around the sleeve 10 using conventional overmolding techniques. The panel may have a hardness range of about 5 to 50 Durometer Shore A.

According to some embodiments of the present invention, panel surface 32 may be smooth or may contain patterns/impressions formed therein. It is recognized that the flexible sleeve 10 may separately include patterns/impressions formed therein. According to some embodiments of the present invention, panel 30 may be clear or may have one or more colors and/or graphics/patterns thereon.

Figure 7:
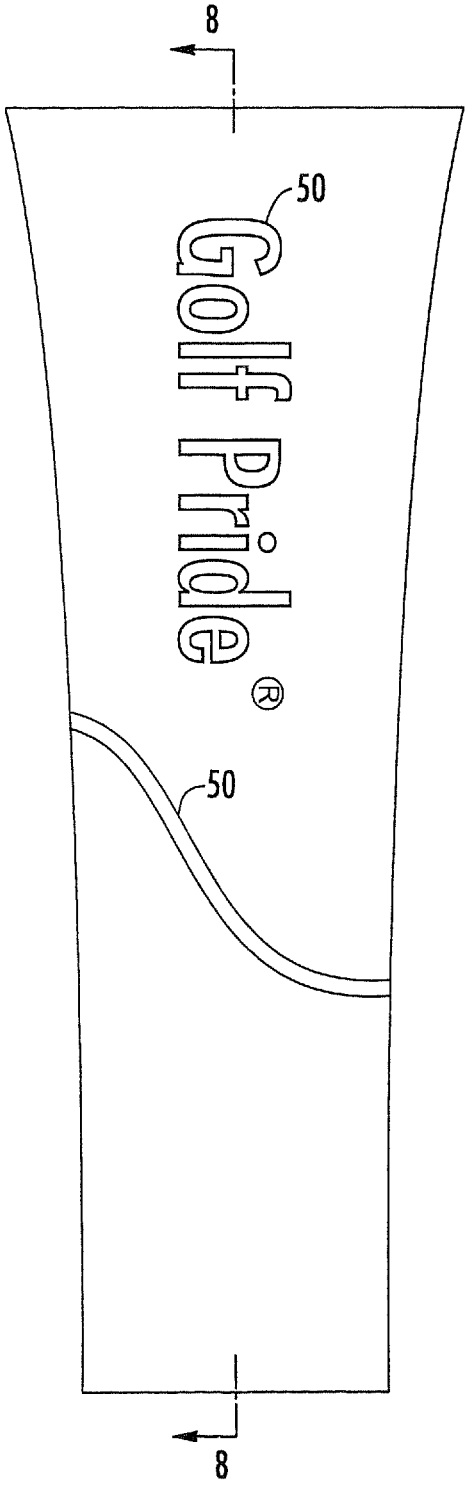
FIG. 7 is a plan view of the flexible silicone panel of FIG. 6 with printed indicia and an additional layer of clear silicone thereon, according to some embodiments of the present invention.
Figure 8:
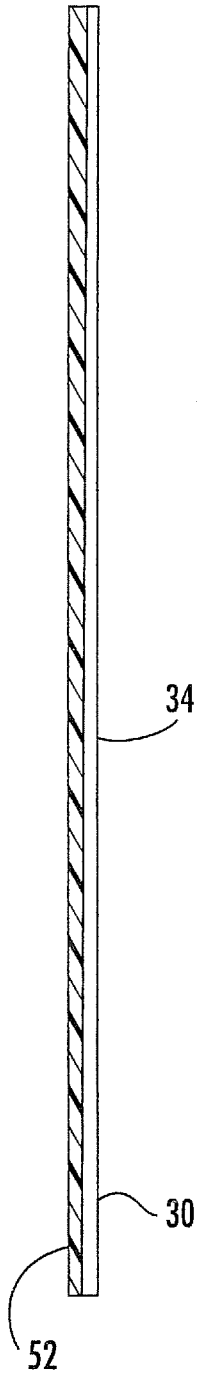
FIG. 8 is a cross-sectional view of the flexible silicone panel of FIG. 7 taken along Lines 8-8.

Referring to FIGS. 7-8, printed indicia 50 has been applied to the first surface 32 of the panel 30 of FIG. 6. The printed indicia 50 is formed by applying silicone ink in any of various methods such as, for example, screen printing. Suitable silicone ink components are available from Rhodia Silicone, Dow Corning, and GE Silicone, and may be based on vinyl functionalized polydimethylsiloxane (PMDS). In the illustrated embodiment, a layer 52 of clear, flexible silicone is applied to the panel first surface 32 (e.g., via spraying, etc.) so as to overlie the printed indicia 50. Additional layers of silicone may be applied, according to some embodiments of the present invention. These layers of silicone may be transparent or clear and/or may have various patterns, graphics, and/or color(s). The silicone is available from Dow, GE Silicone or Wacker, for example.

Figure 9:
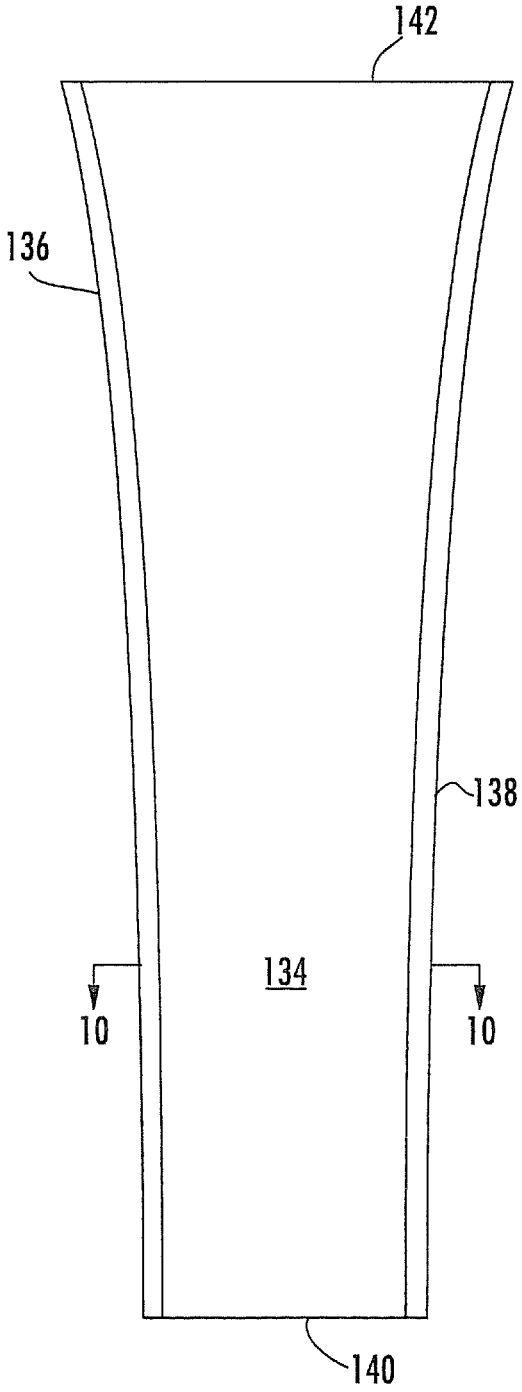
FIG. 9 is a plan view of a flexible silicone panel, according to some embodiments of the present invention.
Figure 10:
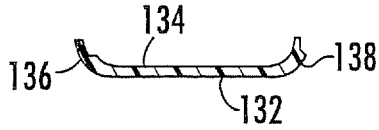
FIG. 10 is a cross-sectional view of the flexible silicone panel of FIG. 9 taken along Lines 10-10.
Figure 18:
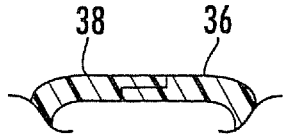
FIG. 18 is an enlarged partial view of the mating relationship of opposite edge portions of the flexible panel of FIG. 17.

Referring to FIGS. 9-10, an elongated flexible panel 130 of silicone, according to other embodiments of the present invention, and that is configured to be wrapped around and bonded to the sleeve 10, is illustrated. The illustrated panel 130 includes opposite first and second surfaces 132,134, opposite first and second edge portions 136,138, and opposite proximal and distal end portions 140,142, similar to the flexible panel 30 illustrated in FIG. 6. The first and second edge portions 136,138, are formed such that they curl upwardly, as illustrated in FIG. 10. The first and second edge portions 136,138 are also configured such that they will join together in mating relationship. The illustrated first and second edge portions 136,138 form a lap joint when joined in mating relationship (FIG. 18).

The upwardly curl in the first and second edge portions 136,138 facilitates joining the first and second edge portions 136,138 together when the panel 130 is wrapped around sleeve 10. This curl may be imparted to the first and second edge portions 136,138 in various ways, such as molding.

Figure 11:
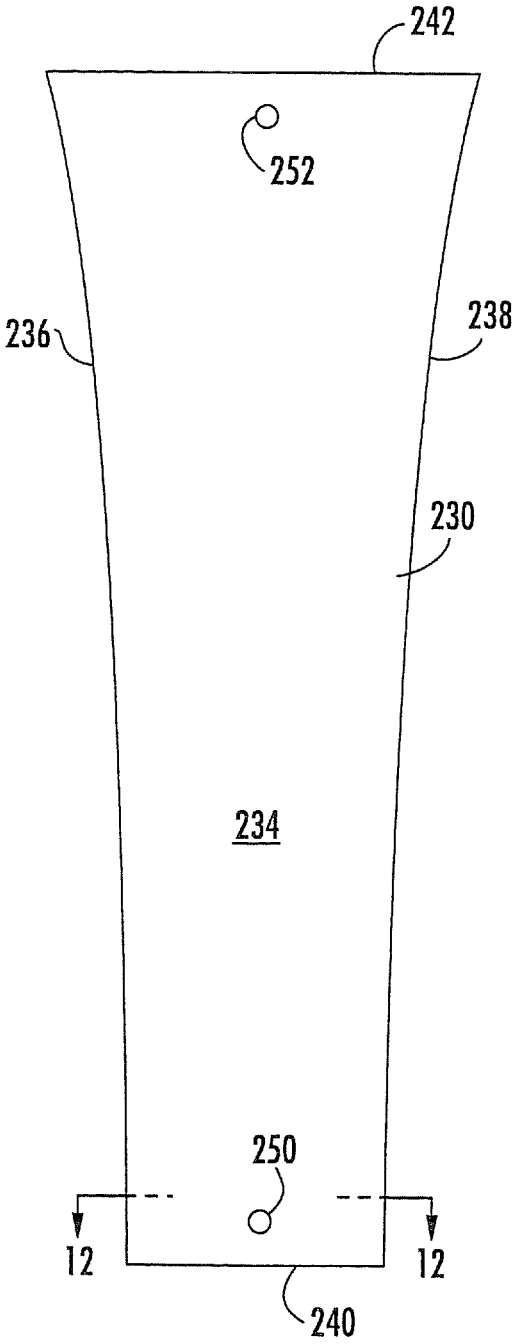
FIG. 11 is a plan view of a flexible silicone panel, according to some embodiments of the present invention.
Figure 12:
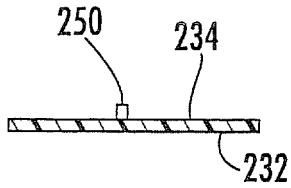
FIG. 12 is a cross-sectional view of the flexible silicone panel of FIG. 11 taken along Lines 12-12.

Referring to FIGS. 11-12, an elongated flexible panel 230 of silicone, according to other embodiments of the present invention, and that is configured to be wrapped around and bonded to a sleeve, is illustrated. The illustrated panel 230 includes opposite first and second surfaces 232,234, opposite first and second edge portions 236,238, and opposite proximal and distal end portions 240,242, similar to the panel 30 illustrated in FIG. 6.

The illustrated panel 230 includes a first registration pin 250 that extends outwardly from the panel second surface 234 adjacent the panel proximal end 240 and a second registration pin 250 that extends outwardly from the panel second surface 234 adjacent the panel distal end 242. The registration pins 250,252 are configured to be inserted within respective apertures in a sleeve (10', FIG. 13) when the panel 230 is wrapped therearound. The registration pins 250,252 maintain the panel in proper alignment during wrapping and subsequent bonding. Accordingly, patterns, text and graphics disposed on the panel first surface 232 can be properly aligned or registered relative to a seam formed by joining the first and second edge portions 236,238. For example, if a pattern extends to first edge portion 236 and continues at second edge portion 238, the registration pins 250,252 facilitate aligning the pattern during wrapping and subsequent bonding.

Figure 13:
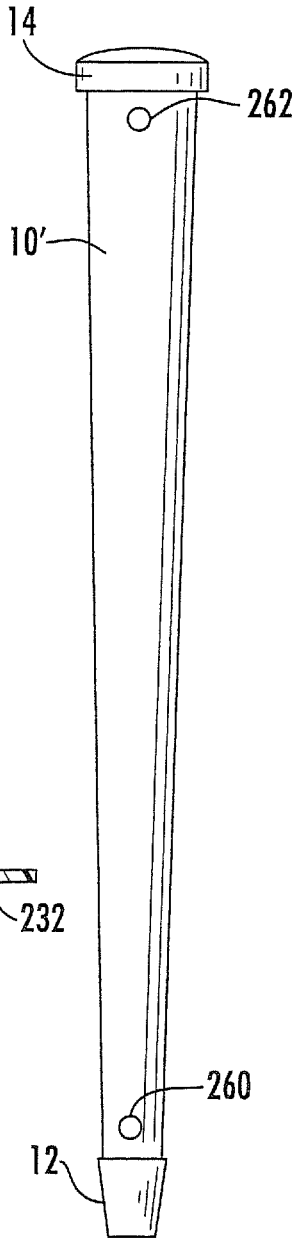
FIG. 13 is a side elevational view of a flexible sleeve for a golf club grip that is configured to receive the flexible silicone panel of FIG. 11, according to some embodiments of the present invention.

Referring to FIG. 13, a sleeve 10' is illustrated with opposite proximal and distal ends 12,14, as described above with respect to FIGS. 1-2. The illustrated sleeve 10' includes a first registration aperture 260 formed within the sleeve 10' adjacent the sleeve proximal end 12 and a second registration aperture 262 formed within the sleeve adjacent the sleeve distal end 14. The first registration pin 250 of panel 230 engages the first registration aperture 260 and the second registration pin 252 engages the second registration aperture 262 when the panel 230 is wrapped around sleeve 10'.

Other methods of alignment are possible. For example, a sleeve and/or flexible panel may include registration marks that can be used when wrapping a flexible panel around a sleeve so as to accurately align patterns, etc.

Figure 14:
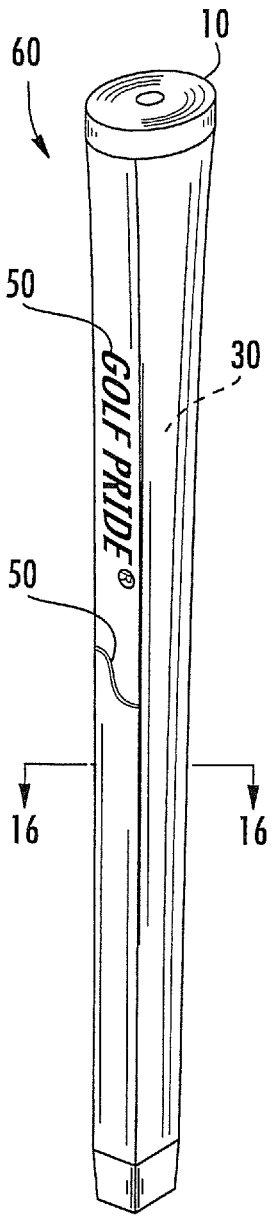
FIG. 14 is a perspective view of a golf club grip wherein the flexible panel of FIG. 7 has been wrapped around and integrally bonded to the flexible sleeve of FIG. 1, according to some embodiments of the present invention.
Figure 15:
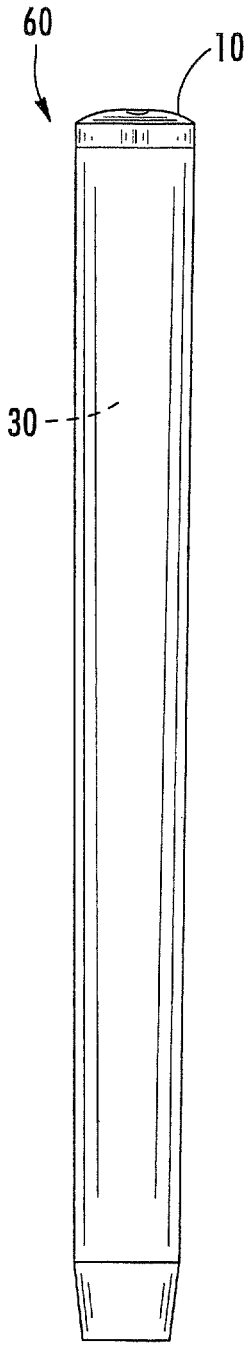
FIG. 15 is a side elevational view of the golf club grip of FIG. 14.
Figure 16:
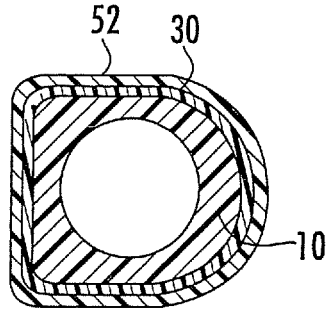
FIG. 16 is a cross-sectional view of the golf club grip of FIG. 14 taken along Lines 16-16.

Referring now to FIGS. 14-16, panel 30, with printed indicia and an overlying layer of silicone 52, has been wrapped around and bonded to sleeve 10 to form a golf club grip 60. According to some embodiments of the present invention, a primer may be applied (e.g., screened or sprayed) to the non-printed surface (i.e., second surface 34 of panel 30) of the flexible panel 30 (and/or to sleeve 10) prior to wrapping the panel 30 around the sleeve 10. Exemplary silicone-based primers are available from Dow, GE Silicone or Wacker.

Figure 4:
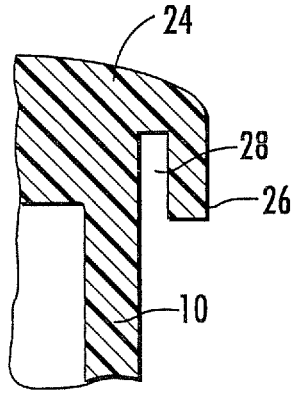
FIG. 4 is a cross-sectional view of the sleeve of FIG. 2 taken along Lines 4-4.
Figure 5:
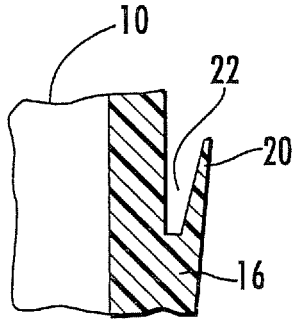
FIG. 5 is a cross-sectional view of the sleeve of FIG. 2 taken along Lines 5-5.

In the illustrated embodiment, the first and second edge portions 36,38 of the panel 30 are matingly joined. Additional silicone may be applied to the first and second edge portions 36,38. Suitable silicones are available from Dow, GE Silicone or Wacker. When heated, this silicone facilitates bonding of the first and second edge portions 36,38. In the illustrated embodiment, the panel proximal end 40 is received within the nipple circumferential slot 22 (FIG. 5) and the panel distal end 42 is received within the cap circumferential slot 28 (FIG. 4). The panel 30 and sleeve 10 have been subjected to conditions (e.g., heat and/or pressure) such that the panel 30 and sleeve 10 become integrally bonded, such as via crosslinking.

Embodiments of the present invention do not require the panel proximal end 40 to be disposed within nipple circumferential slot 22, nor require the panel distal end 42 to be disposed within the cap circumferential slot 28. The panel distal end 42 may not extend all the way to the sleeve distal end 14 according to some embodiments, and/or the panel proximal end 40 may not extend all the way to the sleeve distal end 12 according to some embodiments.

Figure 17:
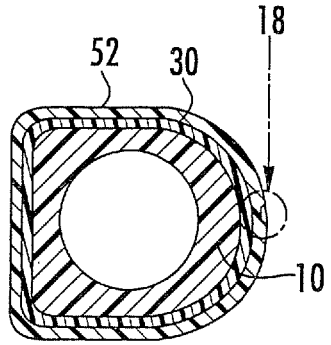
FIG. 17 is a cross-sectional view of the golf club grip of FIG. 14 illustrating the mating relationship of opposite edge portions of the flexible panel, according to some embodiments of the present invention.

FIGS. 17-18 illustrate a lap joint that is formed by the first and second edge portions 36,38 of the flexible panel, according to some embodiments of the present invention.

According to other embodiments of the present invention, a flexible panel, such as illustrated in FIG. 6, can be molded into a grip for a golf club without requiring the use of a sleeve. In other words, a flexible panel can be molded into a finished grip ready to receive a golf club shaft therein. Printed indicia may be applied to the flexible panel via silicone ink as described above and may include one or more additional layers of silicone thereon.

Figure 19:
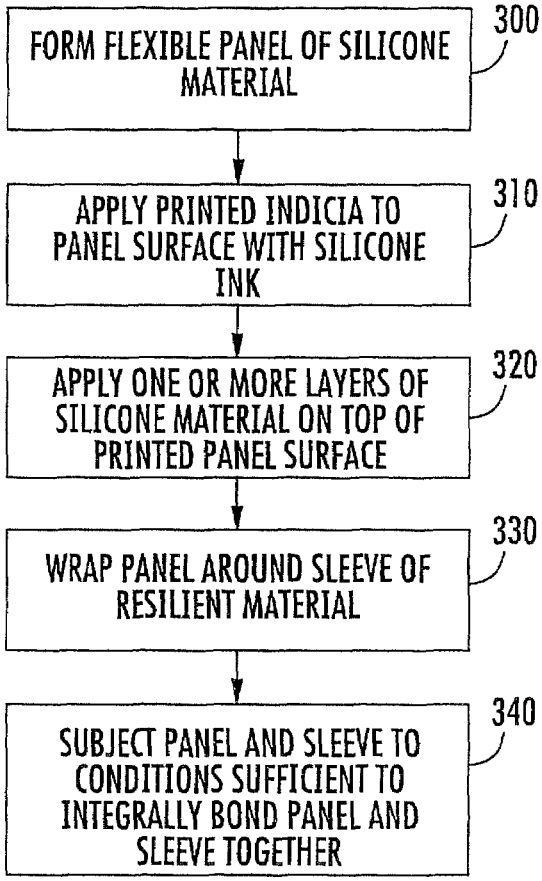
FIG. 19 is a flow chart of operations for forming a grip for a golf club, or other apparatus, according to some embodiments of the present invention.

Referring now to FIG. 19, operations for forming a grip for a golf club, or other article, according to some embodiments of the present invention, are illustrated. A flexible panel of silicone is formed (Block 300). The panel may be formed such that opposite edge portions are configured to join in mating relationship as described and illustrated above. The panel may be molded or subjected to other processes so as to impart an upwardly curl to opposite edge portions, as illustrated and described above, and/or to include impressions/patterns therein.

Silicone ink is applied to a first surface of the flexible panel to form printed indicia thereon (Block 310). The printed indicia may include text, graphics, patterns, colors, etc., and may be applied to the panel surface in various ways. One or more layers of silicone material may be applied to the panel first surface so as to overlie the printed indicia (Block 320). The additional one or more layers may be clear layers and/or layers having various colors/patterns/graphics thereon, without limitation.

The flexible panel is then wrapped around an elongated flexible sleeve that is configured to slip onto the shaft of a golf club (Block 330). The flexible panel second surface is in face-to-face contacting relationship with the sleeve and the first and second edge portions are joined together to define a longitudinal seam. The panel and sleeve are then subjected to conditions sufficient to integrally bond the panel to the sleeve without the use of adhesive material (Block 340).

One or more additional layers of silicone available from Dow, GE Silicone or Wacker may be applied to the grip for appearance (Block 350). For example, one or more additional layers may provide a shiny appearance, a flat appearance, patterns, abrasion resistance, ultraviolet ray protection, etc.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A grip for a golf club, comprising:

an elongated flexible sleeve that slips onto the shaft of a golf club; and an elongated silicone material flexible panel wrapped around the sleeve, adhesive properties of the silicone material upon curing integrally bond the silicone material flexible panel to the sleeve, wherein the panel comprises:

opposite first and second surfaces;

opposite first and second edge portions joined together to define a longitudinal seam; and printed indicia on the panel first surface, wherein the printed indicia comprises silicone ink.

2. The grip of claim 1, wherein the sleeve comprises silicone material.

3. The grip of claim 1, wherein the panel first and second edges are joined together in mating relationship.

4. The grip of claim 1, wherein the panel first and second edges are joined together to form a lap joint.

5. The grip of claim 1, wherein the sleeve comprises a registration aperture formed therein, wherein the panel comprises a registration pin extending outwardly from the panel second surface, and wherein the registration pin engages the registration aperture.

6. The grip of claim 1:

wherein the sleeve comprises:

a proximal end and an opposite distal end;

a first registration aperture formed within the sleeve adjacent the proximal end and a second registration aperture formed within the sleeve adjacent the distal end; and wherein the panel comprises:

a proximal end and an opposite distal end;

a first registration pin extending outwardly from the panel second surface adjacent the proximal end and a second registration pin extending outwardly from the panel second surface adjacent the distal end, wherein the first registration pin engages the first registration aperture and the second registration pin engages the second registration aperture.

7. The grip of claim 1, wherein the panel comprises a layer of clear silicone bonded to the panel first surface and overlying the printed indicia.

8. The grip of claim 1, further comprising a nipple at a proximal end of the sleeve, wherein the nipple comprises an upwardly facing circumferential slot, and wherein a proximal end of the panel is received within the slot.

9. The grip of claim 1, further comprising a cap at a distal end of the sleeve, wherein the cap comprises a downwardly facing circumferential slot, and wherein a distal end of the panel is received within the slot.

* * * * *